US009813822B2

(12) United States Patent
Wang et al.

(10) Patent No.: US 9,813,822 B2
(45) Date of Patent: Nov. 7, 2017

(54) VIBRATION SPEAKER

(71) Applicants: Hongxing Wang, Shenzhen (CN); Rongguan Zhou, Shenzhen (CN)

(72) Inventors: Hongxing Wang, Shenzhen (CN); Rongguan Zhou, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 9 days.

(21) Appl. No.: 14/983,651

(22) Filed: Dec. 30, 2015

(65) Prior Publication Data

US 2016/0219372 A1 Jul. 28, 2016

(30) Foreign Application Priority Data

Jan. 26, 2015 (CN) ..... 2015 2 0053589

(51) Int. Cl.
*H04R 17/00* (2006.01)
*H04R 7/18* (2006.01)
*H04R 7/04* (2006.01)

(52) U.S. Cl.
CPC ..... *H04R 17/005* (2013.01); *H04R 7/18* (2013.01); *H04R 7/04* (2013.01); *H04R 2400/11* (2013.01); *H04R 2499/15* (2013.01)

(58) Field of Classification Search
CPC ..... H04R 1/021; H04R 1/025; H04R 7/04; H04R 7/06; H04R 7/10; H04R 7/16–7/22; H04R 17/00; H04R 17/005; H04R 2400/03; H04R 2400/11; H04R 2440/01; H04R 2440/05; H04R 2440/07; H04R 2499/11; H04R 2499/15
See application file for complete search history.

(56) References Cited

U.S. PATENT DOCUMENTS 9,148,716 B2 * 9/2015 Liu ..... H04R 1/021
2012/0057730 A1 * 3/2012 Fujise ..... H04R 17/00 381/190
2013/0182878 A1 * 7/2013 Liu ..... H04R 1/021 381/333
2013/0287242 A1 * 10/2013 Nabata ..... H04R 1/2888 381/388
2014/0306914 A1 * 10/2014 Kagayama ..... G06F 3/016 345/173

* cited by examiner

*Primary Examiner* — Joshua Kaufman
(74) *Attorney, Agent, or Firm* — Na Xu; IPro, PLLC

(57) ABSTRACT

A vibration speaker includes a screen; a frame for supporting the screen; a support attached to the frame, including a first supporting part and a second supporting part; and a piezoelectric vibrator fixed on the support for actuating the screen to vibrate. The piezoelectric vibrator is respectively connected to the first supporting part and the second supporting part.

14 Claims, 2 Drawing Sheets

VIBRATION SPEAKER

FIELD OF THE DISCLOSURE

The present disclosure generally relates to speaker technologies, and more particularly, to a vibration speaker for generating sound by actuating a screen or a cover of an electronic apparatus.

BACKGROUND

Piezoelectric vibrators are applied in mobile communication devices for actuating display screens of the mobile communication devices to vibrate so as to generate sound. In a related mobile communication device with a screen, a piezoelectric vibrator is attached to a frame of the mobile communication device, for actuating the screen to vibrate.

However, the frame of the mobile communication device becomes narrower to meet a large-screen requirement, and thus the piezoelectric vibrator cannot be fixed on the frame firmly.

Therefore, it is desired to provide a vibration speaker to overcome the aforesaid problems.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

The present disclosure will be described in detail below with reference to the attached drawings and embodiments thereof.

Figure 1:
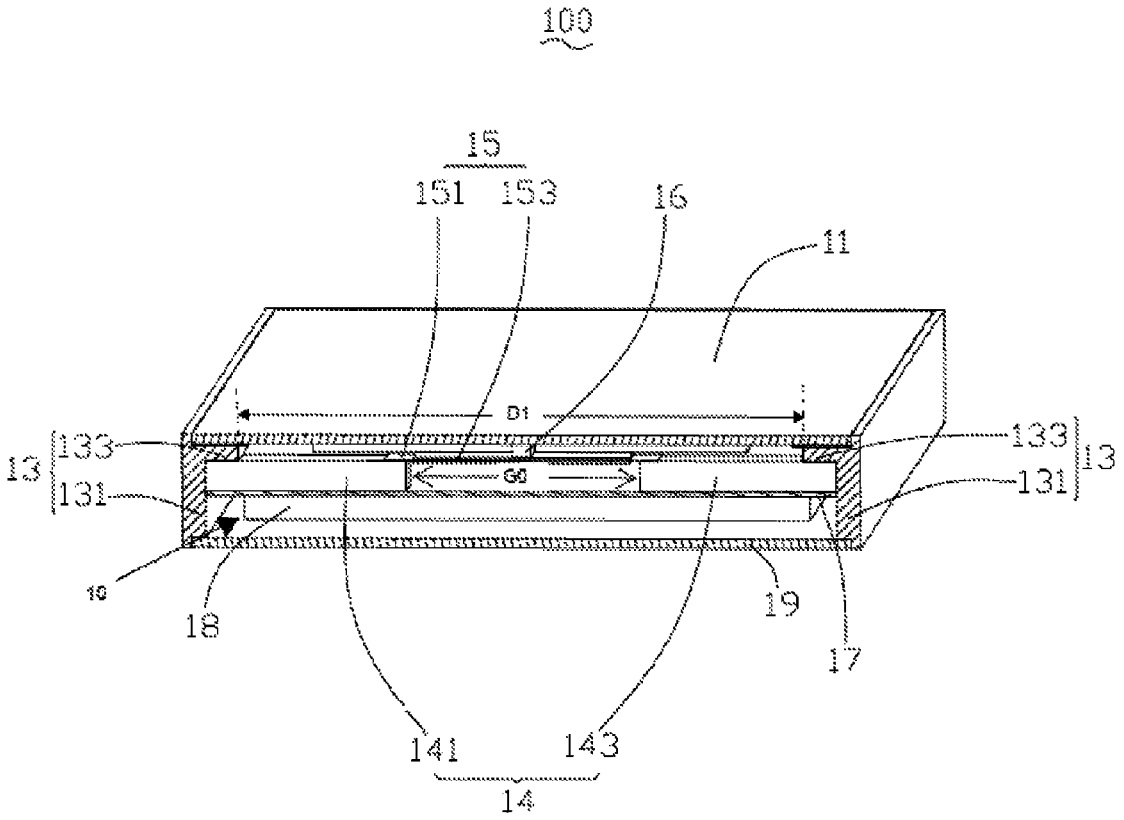
FIG. 1 schematically illustrates a vibration speaker according to a first exemplary embodiment of the present disclosure.

Referring to FIG. 1, a vibration speaker 100 according to a first exemplary embodiment of the present disclosure includes a screen 11, a frame 13 having a receiving space 10 formed therein, a support 14, a piezoelectric vibrator 15, a vibration transferring member 16, an inner plate 17, a spacing member 18 and a rear cover 19.

The screen 11 generally includes a protective glass, a touch sensing layer and a display panel, which are disposed in an order from top to bottom. An overlapped area of the protective glass, the touch sensing layer and the display panel, which is located at a main central region of the screen 11, is defined as an active area of the screen 11, and optionally, a peripheral area surrounding the active area may be defined as a non-active area of the screen 11.

The frame 13 may be a metal frame, and is configured for supporting the screen 11. The frame 13 includes a main body with a pair of sidewalls 131 opposite to each other. Each of the sidewalls 131 includes a protrusion part 133 protruding perpendicularly from an inner surface thereof. The screen 11 is received in the frame 13 and supported by the protrusion parts 133 of the sidewalls 131.

The support 14 includes a first supporting part 141 and a second supporting part 143 spaced from each other. The first supporting part 141 and the second supporting part 143 are respectively fixed to the two opposite sidewalls 131 of the frame 13. The first supporting part 141 and a second supporting part 143 extend towards each other from each of the sidewalls 131 separately into the receiving space 10. A gap G0 is formed between the first supporting part 141 and the second supporting part 143, and the piezoelectric vibrator 15 spans the gap G0. The protrusion parts 133 are sandwiched between the screen 11 and the support 14. A distance D1 is formed between two of the protrusion parts 133 which are opposite with each other, and the gap G0 has a width smaller than the distance Dl. For example, as illustrated in FIG. 1, the first supporting part 141 and the second supporting part 143 are respectively fixed to bottoms of the protrusion parts 133 of the two opposite sidewalls 131, and abut against the bottoms of the protrusion parts 133. In one embodiment, the first supporting part 141 and the second supporting part 143 may be two separate elements, and alternatively, in another embodiment, the first supporting part 141 and the second supporting part 143 may be integrated into a one-piece structure.

Furthermore, the first supporting part 141 and the second supporting part 143 may be fixed to the protrusion parts 133 by a welding approach or a screwing approach. Specifically, if the screwing approach is applied, screwing holes may be formed at both the first supporting part 141 and the second supporting part 143, and extending to the corresponding protrusion parts 133 respectively; in addition, screws may be provided and run through the screwing holes to fix the first supporting part 141 and the second supporting part 143 onto the protrusion parts 133. Preferably, sinking grooves may be formed in the first supporting part 141 and the second supporting part 143 to receive screw heads, so as to prevent the screws from impacting neighboring components.

Moreover, the support 14 may be a plastic support, and when the frame 13 is a metal frame, the first supporting part 141 and the second supporting part 143 may be formed in the frame 13 by using an injection molding process.

The piezoelectric vibrator 15 is disposed between the first supporting part 141 and the second supporting part 143. The piezoelectric vibrator 15 includes a metal substrate 151 and a pair of piezoelectric layers 153. The piezoelectric layers 153 are respectively attached onto two opposite surfaces of the metal substrate 151. The piezoelectric layers 153 are made of piezoelectric ceramic, and configured for performing deformation and vibration under control of an electrical driving signal, and actuating the screen 11 to vibrate and generate sound.

Two opposite ends of the metal substrate 151 are respectively connected to the first supporting part 141 and the second supporting part 143. Preferably, the two opposite ends of the metal substrate 151 may be supported by and fixed to supporting surfaces of the first supporting part 141 and the second supporting part 143, and the supporting surfaces of the first supporting part 141 and the second supporting part 143 face the screen 11.

For example, the two opposite ends of the metal substrate 151 may respectively be fixed to the first supporting part 141 and the second supporting part 143 by a welding approach or a screwing approach. Specifically, if the screwing approach is applied, screwing holes may be formed at the first supporting part 141 and the second supporting part 143, and extending to the corresponding metal substrate 151, respectively. In addition, screws may be provided and run through the screwing holes to fix first supporting part 141 and the second supporting part 143 onto the metal substrate 151.

The vibration transferring member 16 is configured for transferring vibration of the piezoelectric vibrator 15 to the screen 11, so as to actuate the screen 11 to vibrate and generate sound. The vibration transferring member 16 may be in a block shape, and is disposed between the piezoelectric vibrator 15 and the screen 11. Specifically, a surface of the vibration transferring member 16 abuts against and contacts the piezoelectric layer 153 of the piezoelectric vibrator 15, while an opposite surface of the vibration transferring member 16 abuts against and contacts the glass protective layer of the screen 11. The vibration transferring member 16 can be made of material selected from stainless steel, acrylonitrile butadiene styrene copolymers (ABS) plastic, polycarbonate (PC) plastic or other hard materials.

In one embodiment, the vibration transferring member 16 may be disposed between the non-active area of the screen 11 and the piezoelectric vibrator 15. In particular, the vibration transferring member 16 may abut against a bottom of the protective glass at the non-active area. Alternatively, in another embodiment, the screen 11 may have no non-active area, and the vibration transferring member 16 may directly abut against a rear surface of the screen 11 at the active area thereof.

Edges of the inner plate 17 are fixed to the two opposite sidewalls 131 of the frame 13; the support 14 separates the inner plate 17 from the screen 11. The inner plate 17 can have a certain distance from the support 14, to form a gap therebetween. The existence of the gap can prevent the inner plate 17 from being stricken and producing noise due to vibration of the support 14. Alternatively, the inner plate 17 may be designed to contact a bottom of the support 14. In this circumstance, the support 14 can be carried by the inner plate 17 and thus stability of the first supporting part 141 and the second supporting part 143 can be improved. This can further facilitate the piezoelectric vibrator 15 to actuate the screen 11 to vibrate and generate sound.

The rear cover 19 covers a bottom of the frame 14, and the spacing member 18 is disposed between the rear cover 19 and the inner plate 17. The spacing member 18 includes at least one spacer block. When a plurality of spacer blocks is included, the spacer blocks are distributed under a main central region of the inner plate 17 for supporting the inner plate 17.

In operation, positive electrical signals are applied to the piezoelectric vibrator 15, due to inverse piezoelectric effect of the piezoelectric vibrator 15, the two piezoelectric layers 153 may get opposite polarization directions; this causes one of the piezoelectric layers 153 to be stretched, while the other one of the piezoelectric layers 153 to shrink. Thus, the piezoelectric layers 153 can be driven to vibration and obtain a wide range of vibration amplitude. The vibration transferring member 16 further transfers the vibration of the piezoelectric layers 153 to the screen 11, and actuates the screen 11 to vibrate and generate sound.

Figure 2:
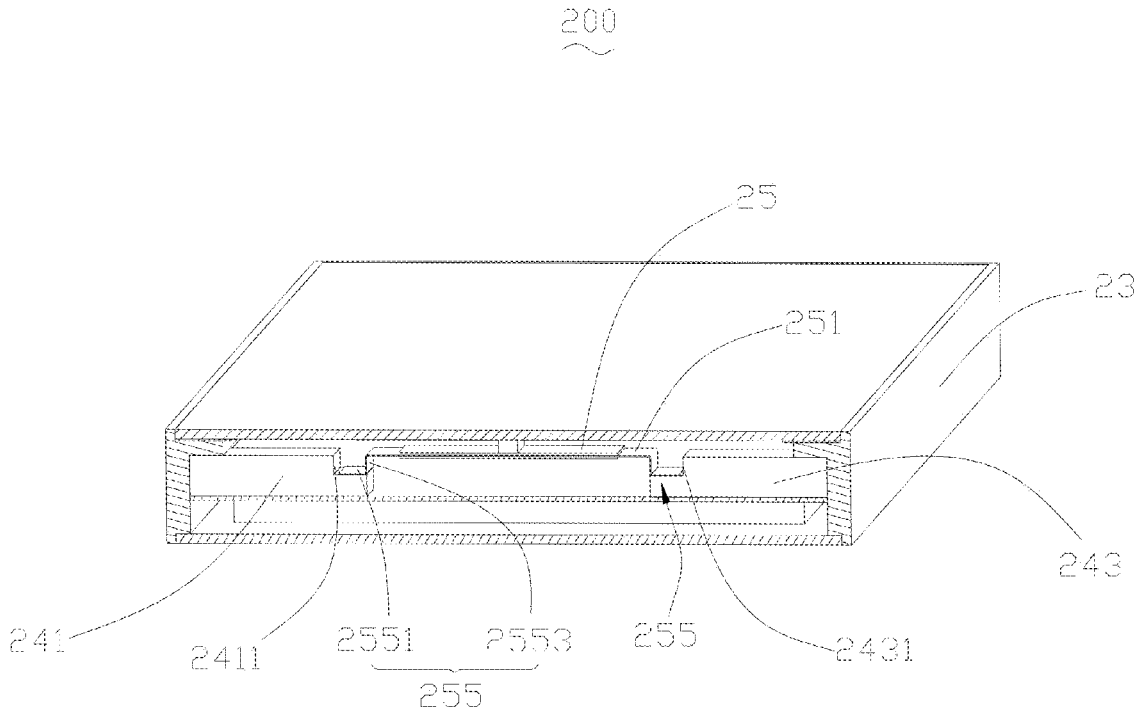
FIG. 2 schematically illustrates a vibration speaker according to a second exemplary embodiment of the present disclosure.

FIG. 2 schematically illustrates a vibration speaker according to a second exemplary embodiment of the present disclosure. The vibration speaker 200 as provided in the present embodiment is similar to the aforementioned vibration speaker 200 as illustrated in FIG. 1, but differs from following aspects.

Each of a first supporting part 241 and a second supporting part 243 of the vibration speaker 200 is designed to have an L-shaped structure, so as to form a first step part 2411 and a second step part 2431 facing each other respectively. Moreover, each of two opposite ends of a metal substrate 251 of a piezoelectric vibrator 25 is correspondingly designed to have an L-shaped fixing structure 255 respectively. The L-shaped fixing structure 255 typically includes a fixing blade 2551 and a connecting blade 2553, the connecting blade 2553 extends perpendicularly from a main body of the metal substrate 251 and towards a corresponding one of the first step part 2411 and the second step part 2431, and the fixing blade 2551 extends perpendicularly from the connecting blade 2553 towards a corresponding sidewall of a frame 23. The fixing blade 2551 is placed on and fixed to the corresponding one of the first step part 2411 and the second step part 243.

The vibration speaker as provided in present disclosure introduces the first supporting part and the second supporting part, which are separately fixed to the two opposite sidewalls of the frame, to support the piezoelectric vibrator. Due to the first supporting part and the second supporting part, the piezoelectric vibrator can be fixed firmly even if the frame is narrow, and thus the vibration speaker is capable of maintaining excellent acoustic performance. Moreover, these configurations can also simplify the assembly of the vibration speaker, thus enhances a yield rate and manufacturing efficiency.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A vibration speaker, comprising:

a screen;

a frame for supporting the screen, the frame having a receiving space formed therein;

a support attached to the frame, including a first supporting part and a second supporting part; and a piezoelectric vibrator fixed on the support for actuating the screen to vibrate; wherein the piezoelectric vibrator is respectively connected to the first supporting part and the second supporting part; wherein:

the frame comprises a pair of sidewalls opposite to each other, the first supporting part attaches to one of the sidewalls, the second supporting part attaches to the other of the sidewalls, the first supporting part and a second supporting part extends towards each other from each of the sidewalls separately into the receiving space, a gap is formed between the first supporting part and the second supporting part, and the piezoelectric vibrator spans the gap;

the vibration speaker further comprises an inner plate fixed to the frame, the inner plate contacting and supporting the support.

2. The vibration speaker as described in claim 1, wherein each of the sidewalls comprises a protrusion part protruding perpendicularly from an inner surface thereof for supporting the screen.

3. The vibration speaker as described in claim 2, wherein the first supporting part and the second supporting part are respectively fixed to the protrusion parts.

4. The vibration speaker as described in claim 3, wherein the protrusion parts are sandwiched between the screen and the support.

5. The vibration speaker as described in claim 4, wherein a distance is formed between two of the protrusion parts which are opposite with each other, and the gap has a width smaller than the distance.

6. The vibration speaker as described in claim 1, wherein the piezoelectric vibrator comprises a metal substrate and a pair of piezoelectric layers attached onto two opposite surfaces of the metal substrate.

7. The vibration speaker as described in claim 6, wherein two opposite ends of the metal substrate are respectively connected to the first supporting part and the second supporting part.

8. The vibration speaker as described in claim 7, wherein each of two opposite ends of the metal substrate is designed to include an L-shaped fixing structure respectively, and the first supporting part and the second supporting part respectively include a first step part and a second step part facing each other.

9. The vibration speaker as described in claim 8, wherein the L-shaped fixing structure comprises a connecting blade and a fixing blade extending perpendicularly from the connecting blade towards a corresponding sidewall of the frame.

10. The vibration speaker as described in claim 9, wherein the fixing blade is placed on and fixed to the corresponding one of the first step part and the second step part.

11. The vibration speaker as described in claim 9, wherein the connecting blade extends perpendicularly from the main body of the metal substrate and towards a corresponding one of the first step part and the second step part.

12. The vibration speaker as described in claim 1, further comprising a vibration transferring member for transferring vibration of the piezoelectric vibrator to the screen; wherein the vibration transferring member is disposed between the piezoelectric vibrator and the screen.

13. The vibration speaker as described in claim 1, wherein the support separates the inner plate from the screen.

14. The vibration speaker as described in claim 1 further comprising a spacing member and a rear cover; wherein the rear cover covers a bottom of the frame, the spacing member is disposed between the rear cover and the inner plate.

* * * * *